US007618758B2

(12) United States Patent
Wu et al.

(10) Patent No.: US 7,618,758 B2
(45) **Date of Patent: *Nov. 17, 2009**

(54) SILANOL CONTAINING PERYLENE PHOTOCONDUCTORS

(75) Inventors: Jin Wu, Webster, NY (US); Nancy L. Belknap, Rochester, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 498 days.

This patent is subject to a terminal disclaimer.

(21) Appl. No.: 11/512,815

(22) Filed: Aug. 30, 2006

(65) Prior Publication Data

US 2008/0057425 A1 Mar. 6, 2008

(51) Int. Cl.
*G03G 5/047* (2006.01)

(52) U.S. Cl. ..... 430/58.8; 430/58.75; 430/59.1; 430/970

(58) Field of Classification Search ..... 430/58.8, 430/58.75, 59.1, 59.4, 970
See application file for complete search history.

(56) References Cited

U.S. PATENT DOCUMENTS

| | | | | |
|---|---|---|---|---|
| 4,265,990 | A | 5/1981 | Stolka et al. | |
| 4,273,846 | A * | 6/1981 | Pai et al. | 430/58.75 |
| 4,587,189 | A | 5/1986 | Hor et al. | |
| 4,921,769 | A | 5/1990 | Yuh et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,876,887 | A * | 3/1999 | Chambers et al. | 430/59.1 |
| 5,905,008 | A * | 5/1999 | Yoshinaga et al. | 430/58.2 |
| 6,376,141 | B1 | 4/2002 | Mishra et al. | |
| 6,713,220 | B2 | 3/2004 | Graham et al. | |
| 6,913,863 | B2 | 7/2005 | Wu et al. | |
| 7,037,631 | B2 | 5/2006 | Wu et al. | |
| 2008/0014517 | A1 * | 1/2008 | Wu et al. | 430/58.2 |

OTHER PUBLICATIONS

Diamond, Arthur S & David Weiss (eds.) Handbook of Imaging Materials, 2nd ed. New York: Marcel-Dekker, Inc. (Nov. 2001) pp. 401-403.*

Jin Wu et al., U.S. Appl. No. 11/485,645 on Silanol Containing Photoconductors, filed Jul. 12, 2006.

Jin Wu et al., U.S. Appl. No. 11/485,550 on Silanol Containing Photoconductors, filed Jul. 12, 2006.

* cited by examiner

*Primary Examiner*—Christopher RoDee
(74) *Attorney, Agent, or Firm*—E. O. Palazzo

(57) ABSTRACT

A photoconductor containing an optional supporting substrate, a perylene silanol photogenerating layer, and at least one charge transport layer.

23 Claims, No Drawings

SILANOL CONTAINING PERYLENE PHOTOCONDUCTORS

CROSS REFERENCE TO RELATED APPLICATIONS

U.S. application Ser. No. 11/512,841, Publication No. 20080057428, filed Aug. 30, 2006, the disclosure of which is totally incorporated herein by reference, on Titanyl Phthalocyanine Photoconductors by Jin Wu et al.

U.S. application Ser. No. 11/512,779, Publication No. 20080057422, filed Aug. 30, 2006, the disclosure of which is totally incorporated herein by reference, on Titanyl Phthalocyanine Silanol Photoconductors by Jin Wu et al.

U.S. application Ser. No. 11/512,838, Publication No. 20080057423, filed Aug. 30, 2006, the disclosure of which is totally incorporated herein by reference, on Titanyl Phthalocyanine Silanol Terphenyl Photoconductors by Jin Wu et al.

U.S. application Ser. No. 11/512,778, Publication No. 20080057421, filed Aug. 30, 2006, the disclosure of which is totally incorporated herein by reference, on Silanol Containing Perylene Photoconductors by Jin Wu et al.

U.S. application Ser. No. 11/485,645, Publication No. 20080014517, filed Jul. 12, 2006, on Silanol Containing Photoconductors, the disclosure of which is totally incorporated herein by reference illustrating a photoconductor containing an optional supporting substrate, a silanol containing photogenerating layer, and at least one charge transport layer.

U.S. application Ser. No. 11/485,550, Publication No. 20080014516, filed Jul. 12, 2006, the disclosure of which is totally incorporated herein by reference, illustrating an imaging member comprising an optional supporting substrate, a photogenerating layer, and at least one charge transport layer comprised of at least one charge transport component, and at least one silanol.

A number of the components and amounts thereof of the above copending applications, such as the supporting substrates, resin binders, photogenerating layer components, antioxidants, charge transport components, hole blocking layer components, silanols, the perylene BZP, comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, adhesive layers, and the like, may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a substrate, a photogenerating layer, and a charge transport layer, inclusive of a plurality of charge transport layers, such as a first charge transport layer and a second charge transport layer, an optional adhesive layer, an optional hole blocking or undercoat layer, and an optional overcoating layer, and wherein the photogenerating layer contains, for example, a polymer or resin binder, at least one photogenerating perylene pigment of, for example, BZP comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra (2,1,9-def:6,5,10-d'e'f')diisoquinoline-10,21-dione, and a silanol; and wherein at least one of the charge transport layers also includes a silanol therein. Therefore, at least one of the charge transport layers can contain a silanol in embodiments, the photogenerating layer, and at least one of the charge transport layers may contain a silanol; and in embodiments the photogenerating layer may contain a silanol, and the charge transport layers can be free of a silanol.

The photoreceptors illustrated herein, in embodiments, possess excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability.

At least one in embodiments refers, for example, to one, to from 1 to about 10, to from 2 to about 7, to from 2 to about 4, to two, and the like. Moreover, the silanol can be added to the photogenerating layer that is, for example, instead of being dissolved in the photogenerating layer solution, the silanol can be added to the photogenerating layer as a dopant, and more specifically, the silanol can be included in the photogenerating layer dispersion prior to the deposition of this layer on the substrate. Incorporation of the BZP and silanol in the photogenerating layer permits, for example, a lower $V_r$, substantially no $V_r$ cycle up of the resulting photoconductor as compared to a photoconductor with no silanol and BZP in the photogenerating layer.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

Disclosed in U.S. Pat. No. 5,645,965, the disclosure of which is totally incorporated herein by reference, are photoconductive imaging members with perylenes and a number of charge transports, such as amines. These charge transports may be selected for the imaging members of the present invention.

Illustrated in U.S. Pat. No. 4,587,189, the disclosure of which is totally incorporated herein by reference, are imaging members comprised of a supporting substrate, a photogenerating layer of BZP perylene, which BZP is comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') and as a top layer a second charge transport layer. The perylenes of this patent can be selected for the photogenerating layer of the photoconductors disclosed herein.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468 wherein there is illustrated a hole blocking layer of titanium dioxide dispersed in a specific linear phenolic binder of VARCUM™, available from OxyChem Company.

The appropriate components, and processes of the above recited patents may be selected for the present disclosure in embodiments thereof.

SUMMARY

Disclosed are imaging members with many of the advantages illustrated herein, such as extended lifetimes of service of, for example, in excess of about 3,000,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-Induced Discharge Curve); excellent photosensitivity, and more specifically, at least about 5 percent increase in photosensitivity as compared to a control photoconductor with no silanol in the photogenerating layer, and when the silanol is present in the charge transport layer at least about 10 percent increase in sensitivity as compared to a control photoconductor with no silanol in the charge transport layer, and the like; layered anti-scratch photoresponsive imaging members which are responsive to near infrared radiation of from about 500 to about 1,000 nanometers; flexible photoresponsive imaging members with sensitivity to visible light; and a layered belt photoresponsive or photoconductive imaging members with mechanically robust and solvent resistant charge transport layers; drum or flexible imaging members with optional hole blocking layers comprised of metal oxides, phenolic resins, and optional phenolic compounds, and which phenolic compounds contain at least two, and more specifically, 2 to 10 phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$. Also disclosed are layered flexible belt photoreceptors containing a wear resistant, and anti-scratch layer or layers, and where the surface hardness of the member is increased by the addition of suitable silanols; and wherein there is permitted the prevention of $V_r$ cycle up, caused primarily by photoconductor aging, for numerous imaging cycles, and layered flexible belt photoreceptors containing a photogenerating layer, and where the photogenerating pigment is modified with hydrophobic moieties by the addition of suitable silanols; and where the imaging members exhibit low background and/or minimal CDS; and the prevention of $V_r$ cycle up, caused primarily by photoconductor aging, for numerous imaging cycles.

EMBODIMENTS

Aspects of the present disclosure relate to an imaging member or photoconductor comprising an optional supporting substrate, a perylene photogenerating layer containing a silanol, and thereover at least one charge transport layer comprised of at least one charge transport component, and optionally at least one silanol, such as for example a silanol containing polyhedral oligomeric silsesquioxane; a photoconductor comprising an optional substrate, a perylene photogenerating layer, a silanol, and at least one charge transport layer comprised of at least one charge transport component, and at least one silanol, and wherein the perylene photogenerating layer is comprised of a perylene photogenerating pigment with a backbone of peri-linked naphthalene units of the following structure

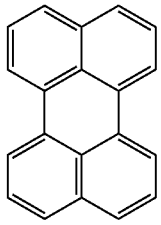

and wherein the silanol is, for example, selected from the group comprised of the following formulas/structures

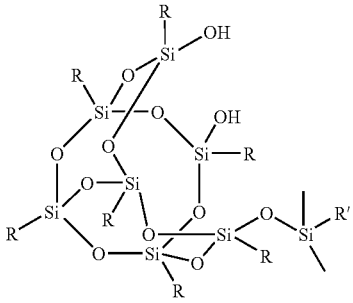

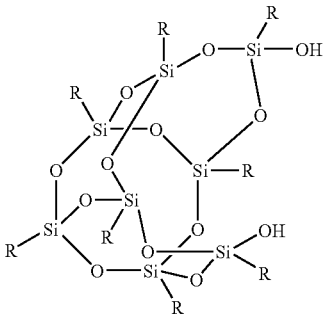

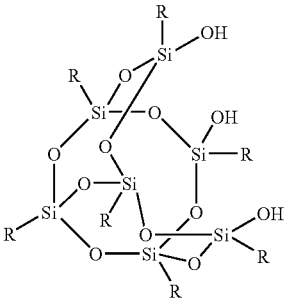

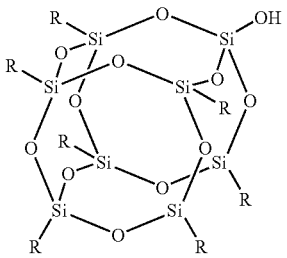

wherein R and R' are independently selected from a suitable hydrocarbon, such as alkyl, alkoxy, aryl, and substituted derivatives thereof, and mixtures thereof; a photoconductor comprised in sequence of a substrate, a perylene photogenerating layer and a silanol, and at least one charge transport layer comprised of at least one charge transport component, and optionally at least one silanol, wherein the silanol is selected from the group comprised of the following formulas/structures

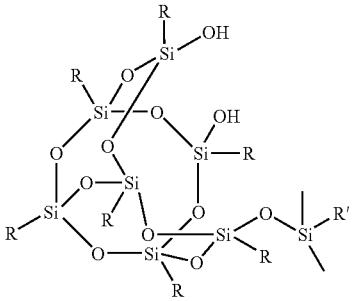

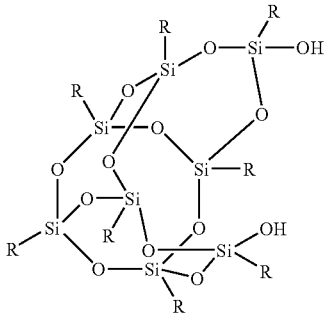

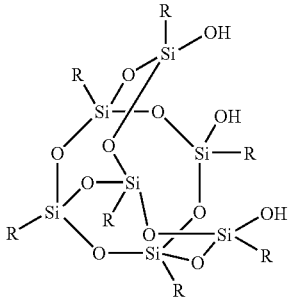

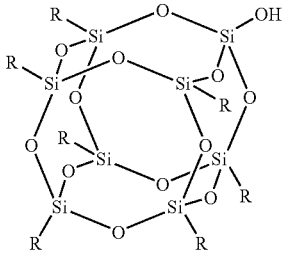

wherein R and R' are independently a suitable hydrocarbon, such as alkyl, aryl, and alkoxy, and wherein the silanol is present in at least one charge transport layer in an amount of from about 0.1 to about 40 weight percent; a flexible imaging member comprising a supporting substrate, a perylene photogenerating layer, and at least two charge transportlayers, at least one silanol of the formulas illustrated herein, which silanols can also be referred to as polyhedral oligomeric silsesquioxane (POSS) silanols

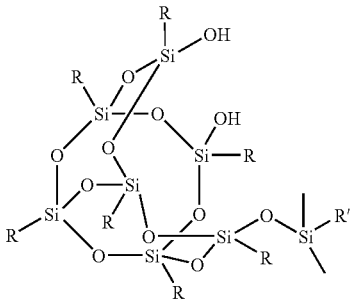

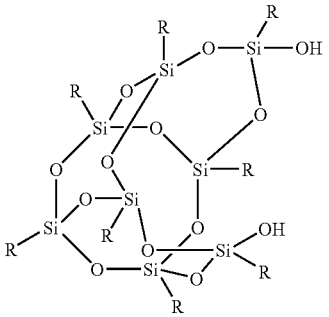

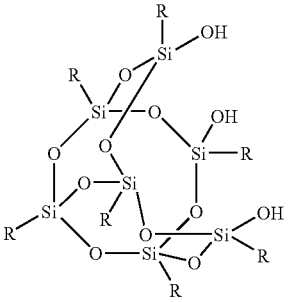

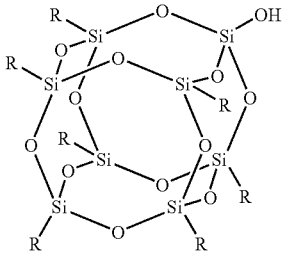

wherein R and R' are independently selected from the group comprised of a suitable hydrocarbon, such as alkyl, alkoxy, aryl, and substituted derivatives thereof, and mixtures thereof with, for example, from 1 to about 24 carbon atoms for alkyl and alkoxy and from 6 to about 36 carbon atoms for aryl, like phenyl, methyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF_3(CF_2)_5$ $CH_2CH_2$—, methacrylolpropyl, norbornenylethyl, and the like, and also wherein the R groups specifically include phenyl, isobutyl, isooctyl, cyclopentyl, cyclohexyl and the like; desired R' group includes methyl, vinyl, fluorinated alkyl, and the like; a photoconductor comprised of a perylene photogenerating layer, and at least one charge transport layer, and wherein the perylene photogenerating layer contains at least one; or wherein both the perylene photogenerating layer and the at least one charge transport layer contains at least one silanol, or wherein the charge transport layers are free of a silanol, and the silanol is included in the perylene photogenerating layer; an imaging member comprising a supporting substrate, a perylene photogenerating layer thereover, and at least one charge transport layer comprised of at least one charge transport component, at least one silanol of the formulas illustrated herein wherein R and R' are independently alkyl, alkoxy, or aryl, or mixtures thereof with, for example, from 1 to about 20 carbon atoms for alkyl, and alkoxy, and from 6 to about 36 carbon atoms for aryl like phenyl, methyl, ethyl, propyl, butyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF_3(CF_2)_5$ $CH_2CH_2$—, methacrylolpropyl, and norbornenylethyl; a photoconductive member comprised of a substrate, a perylene photogenerating layer thereover, at least one to about three charge transport layers thereover, a hole blocking layer, and an adhesive layer wherein in embodiments the adhesive layer is situated between the perylene photogenerating layer and the hole blocking layer, and wherein at least one of the charge transport layers and/or the perylene photogenerating layer contain a silanol, or wherein the silanol is contained solely in the perylene photogenerating layer with the perylene photogenerating layer including a photogenerating component, such as a photogenerating perylene pigment and a resin binder, and the at least one charge transport layer including at least one charge transport component, such as a hole transport component, a resin binder, and known additives like antioxidants; a photoconductive imaging member comprised of a supporting substrate, a perylene silanol containing photogenerating layer thereover, a charge transport layer, and an overcoating charge transport layer; a photoconductive member with a perylene silanol photogenerating layer of a thickness of from about 1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating perylene silanol pigment and a charge transport layer or layers, and thereover an overcoating charge transport layer, and where the transport layer is of a thickness of from about 40 to about 75 microns; a member wherein the silanol, or mixtures thereof, is present in an amount of from about 0.1 to about 40 weight percent, or from about 6 to about 20 weight percent; a member wherein the photogenerating layer contains the photogenerating perylene pigment present in an amount of from about 10 to about 95 weight percent; a member wherein the thickness of the perylene photogenerating layer is from about 0.1 to about 4 microns; a member wherein the perylene photogenerating layer contains an inactive polymer binder; a member wherein the binder is present in an amount of from about 50 to about 90 percent by weight, and wherein the total of all layer components is about 100 percent; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating layer and charge transport layer resinous binder is selected from the group consisting of known suitable polymers like polyesters, polyvinyl butyrals, polyacetals, polycarbonates, polyarylates, polystyrene-b-polyvinyl pyridine, polyvinyl chloride-co-vinyl acetate-co-maleic acid, and polyvinyl formals; an imaging member wherein the photogenerating pigment is a perylene and wherein each of the charge transport layers, especially a first and second layer, comprises a silanol and aryl amines of the formula/structure

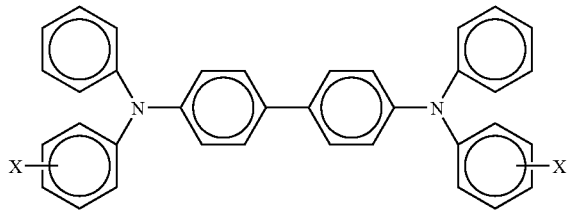

wherein X is selected from the group consisting of alkyl, alkoxy, and halogen, such as methyl and chloride, and wherein there may be present X substituents on each of the outer rings, such as four substituents; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

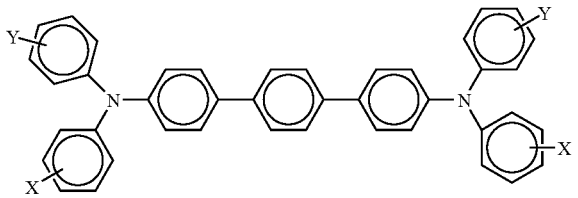

wherein X and Y are independently alkyl, alkoxy, aryl, a halogen, or mixtures thereof, an imaging member and wherein, for example, alkyl and alkoxy contains from about 1 to about 15 carbon atoms; alkyl contains from about 1 to about 5 carbon atoms; and wherein the resinous binder is selected from the group consisting of polycarbonates and polystyrene; a member wherein the perylene photogenerating layer is situated between the substrate and the charge transport; a member wherein the charge transport layer is situated between the substrate and the perylene photogenerating layer, and wherein the number of charge transport layers is 1 or 2; a member wherein the perylene photogenerating layer is of a thickness of from about 0.2 to about 15 microns; a member wherein the photogenerating component amount is from about 0.05 weight percent to about 20 weight percent, and wherein the photogenerating perylene pigment is dispersed in from about 10 weight percent to about 80 weight percent of a polymer binder; a member wherein the thickness of the perylene photogenerating layer is from about 0.1 to about 11 microns; a member wherein the photogenerating and charge transport layer components are contained in a polymer binder; a member wherein the binder is present in an amount of from about 50 to about 90 percent by weight, and wherein the total of the layer components is about 100 percent, and wherein the resinous binder is selected from the group consisting of polyesters, polyvinyl butyrals, polyacetals, polycarbonates, polyarylates, polystyrene-b-polyvinyl pyridine, polyvinyl chloride-co-vinyl acetate-co-maleic acid, and polyvinyl formals; an imaging member wherein the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; a photoconductive imaging member with a blocking layer contained as a coating on a substrate, and an adhesive layer coated on the blocking layer; an imaging member or photoconductor further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a perylene photogenerating layer, a hole transport layer and a top overcoating layer in contact with the hole transport layer, or in embodiments in contact with the perylene photogenerating layer, and in embodiments wherein a plurality of charge transport layers are selected, such as for example, from 2 to about 10, and more specifically, 2 may be selected; and a photoconductive imaging member comprised of an optional supporting substrate, a peryene photogenerating layer and a first, second, and third charge transport layer.

Examples of POSS silanols wherein throughout POSS refers, for example, to polyhedral oligomeric silsesquioxane silanols selected for the perylene photogenerating layer, the charge transport layer, or both the perylene photogenerating layer and the charge transport layer, include isobutyl-POSS cyclohexenyldimethylsilyldisilanol or isobutyl-polyhedral oligomeric silsesquioxane cyclohexenyldimethylsilyldisilanol ($C_{38}H_{84}O_{12}Si_8$), cyclopentyl-POSS dimethylphenyidisilanol ($C_{43}H_{76}O_{12}Si_8$), cyclohexyl-POSS dimethylvinyldisilanol ($C_{46}H_{88}O_{12}Si_8$), cyclopentyl-POSS dimethylvinyldisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(1 3)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol (C44$H_{82}O_{14}Si_8$), isobutyl-POSS methacryidisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyldisi lanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, all commercially available from Hybrid Plastics, Fountain Valley, Calif. In embodiments, the POSS silanol is a phenyl-POSS trisilanol, or phenyl-polyhedral oligomeric silsesquioxane trisilanol of the following formula/structure

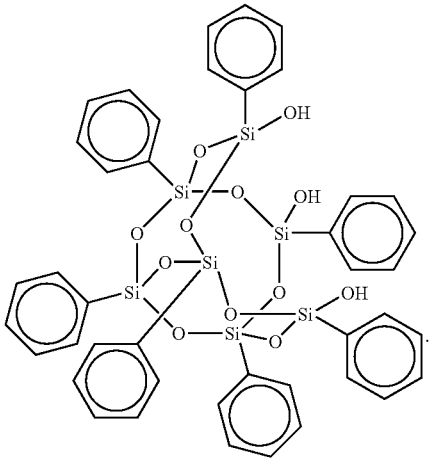

The POSS silanol can contain from about 7 to about 20 silicon atoms, or from about 7 to about 12 silicon atoms. The $M_w$ of the POSS silanol is, for example, from about 700 to about 2,000, or from about 800 to about 1,300.

In embodiments, silanols that can be selected are free of POSS. Examples of such silanols include dimethyl(thien-2-yl)silanol, tris(isopropoxy)silanol, tris(tert-butoxy)silanol, tris(tert-pentoxy)silanol, tris(o-tolyl)silanol, tris(1-naphthyl)silanol, tris(2,4,6-trimethylphenyl)silanol, tris(2-methoxyphenyl)silanol, tris(4-(dimethylamino)phenyl)silanol, tris(4-biphenylyl)silanol, tris(trimethylsilyl)silanol, dicyclohexyltetrasilanol ($C_{12}H_{26}O_5Si_2$), mixtures thereof, and the like.

The silanols, usually hydrophobic in nature, selected for the members, devices, photoconductors illustrated herein are stable primarily in view of the Si—OH substituents in that these substituents eliminate water to form siloxanes, that is Si—O—Si linkages. While not being limited by theory, it is believed that in view of the silanol hindered structures at the other three bonds attached to the silicon that the resulting components are stable for extended time periods, such as from at least one week to over one year. The silanols can be included in the charge transport layer solution or dispersion, or the perylene photogenerating layer solution or dispersion that is, for example, dissolved therein, or alternatively the silanols can be added to the charge transport and/or the perylene photogenerating layer.

Various suitable amounts of the silanols can be selected, such as from about 0.01 to about 50 percent by weight of solids up to about 50, and includes all percentages therebetween like 0.01, 0.05, 0.1, 0.15, 1, 2, 3, 4, 5, 6, 7 throughout, or from about 1 to about 30 percent by weight, or from about 5 to about 20 percent by weight. The silanols can be dissolved in the charge transport layer solution and the perylene photogenerating layer dispersion, or alternatively the silanol can simply be added to the formed charge transport layer and/or the formed perylene photogenerating layer. In embodiments, the silanol is included in the known dispersion milling process when preparing the perylene photogenerating layer. For the perylene photogenerating layer, although not desiring to be limited by theory, it is believed that the photogenerating perylene pigment is modified with a hydrophobic moiety by the in situ attachment of a hydrophobic silanol onto the photogenerating perylene pigment surface with the remainder of the silanol interacting with the resin binder thereby enabling the pigment to be readily dispersible during the dispersion milling process.

Examples of photogenerating perylene pigments include isomers of benzimidazole perylene (BZP) of the formula/structure

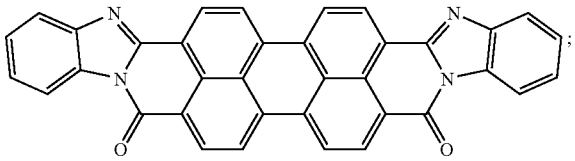

benzimidazole terperylene (BZT) of the formula/structure

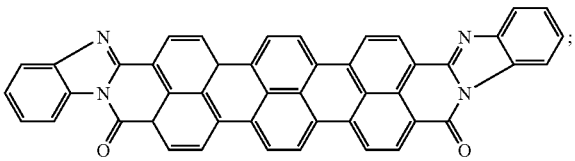

benzimidazole quaterperylene (BZQ) of the formula/structure

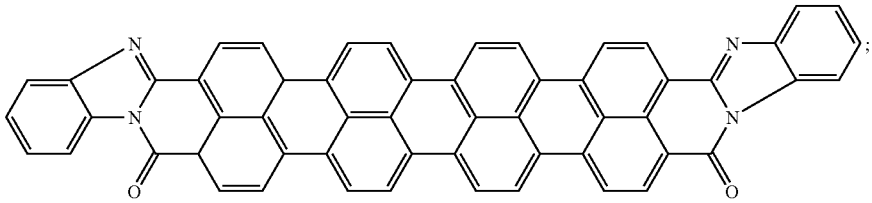

piperidine-modified benzimidazole terperylene (PBZT) of the formula/structure

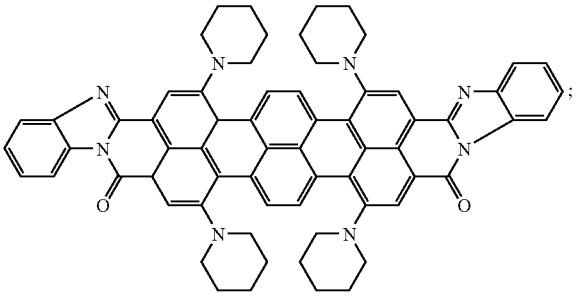

piperidine-modified benzimidazole perylene (PBZP) of the formula/structure

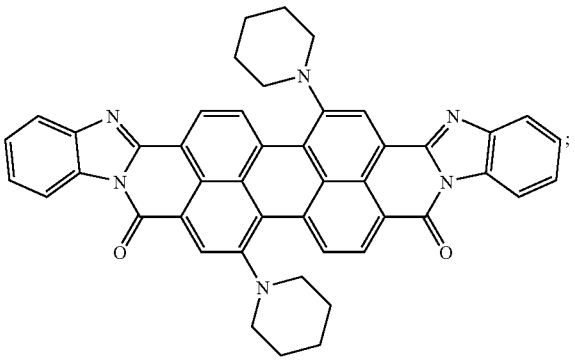

and piperidine-modified benzimidazole quaterperylene (PBZQ) of the formula/structure

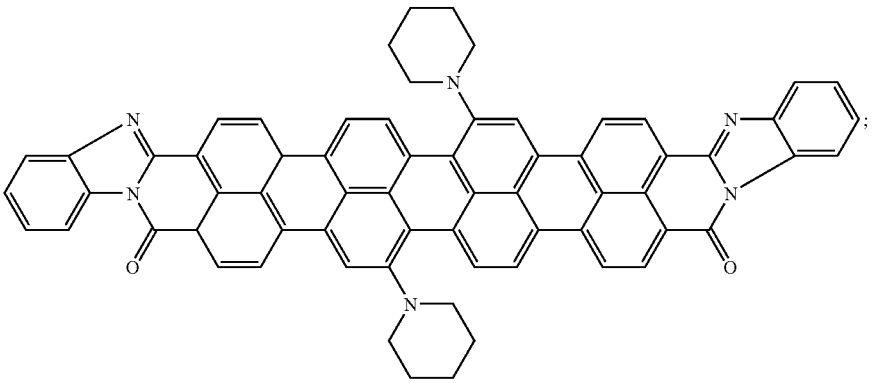

and the like, and mixtures and combinations thereof.

The photogenerating perylene pigment is responsive at a range of, for example, from about 500 nanometers to about 1,500 nanometers, and is generally substantially unresponsive to the light spectrum below about 500 nanometers. Typical wavelengths for photogeneration may be from about 600 nanometers to about 1,200 nanometers and may include a broadband between the two wavelengths. Single wavelength exposure may be from about 650 nanometers to about 1,000 nanometers. Photogenerating benzimidazole perylene absorbs a substantial amount of light at from about 650 to about 700 nanometers.

In general, perylene absorption spectra can be red-shifted via changing the chemical structures such as by (1) increasing the number of perylene units; (2) aryl amination; and (3) introducing piperidine substituents, and the like. Photogenerating benzimidazole terperylene and benzimidazole quaterperylene absorb light at longer wavelength than photogenerating benzimidazole perylene due to the presence of more peri-linked naphthalene units in their molecules. Furthermore, photogenerating piperidine-modified benzimidazole perylene, piperidine-modified benzimidazole terperylene, and piperidine-modified benzimidazole quaterperylene absorb light at longer wavelength than photogenerating benzimidazole perylene due to either the presence of more peri-linked naphthalene units in their molecules and/or piperidine substituents in the bay positions.

The thickness of the photoconductor substrate layer depends on many factors, including economical considerations, electrical characteristics, and the like; thus, this layer may be of a substantial thickness, for example over 3,000 microns, such as from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose, including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness of, for example, about 250 micrometers, or of minimum thickness of less than about 50 micrometers. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The perylene photogenerating layer binder resin is present in various suitable amounts, for example from about 20 to about 80 weight percent, and more specifically, from about 30 to about 70 weight percent, and which resin may be selected from a number of known polymers, such as poly(vinyl butyral), poly(vinyl carbazole), polyesters, polycarbonates, polyarylates, poly(vinyl chloride), polyacrylates and methacrylates; copolymers of vinyl chloride and vinyl acetate; phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the perylene photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, dichloroethane, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 percent by weight to about 90 percent by weight of the photogenerating perylene pigment is dispersed in about 10 percent by weight to about 95 percent by weight of the resinous binder, or from about 20 percent by weight to about 80 percent by weight of the photogenerating perylene pigment is dispersed in about 80 percent by weight to about 50 percent by weight of the resinous binder composition. In one embodiment, about 50 percent by weight of the photogenerating perylene pigment is dispersed in about 50 percent by weight of the resinous binder composition. Various suitable and conventional known processes may be used to mix, and thereafter apply the perylene photogenerating layer coating mixture like spraying, dip coating, roll coating, wire wound rod coating, vacuum sublimation, and the like. For some applications, the perylene photogenerating layer may be fabricated in a dot or line pattern. Removal of the solvent of a solvent-coated layer may be effected by any known conventional techniques such as oven drying, infrared radiation drying, air drying, and the like.

The coating of the perylene photogenerating layer in embodiments of the present disclosure can be accomplished with spray, dip or wire-bar methods such that the final dry thickness of the perylene photogenerating layer is as illustrated herein, and can be, for example, from about 0.01 to about 30 microns after being dried at, for example, about 40° C. to about 150° C. for about 15 to about 90 minutes. More specifically, a perylene photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a perylene photogenerating layer. When desired, an adhesive layer may be included between the charge blocking or hole blocking layer or interfacial layer, and the perylene photogenerating layer. Usually, the perylene photogenerating layer is applied onto the blocking layer and a charge transport layer or plurality of charge transport layers are formed on the perylene photogenerating layer. This device may have the perylene photogenerating layer on top of or below the charge transport layer.

A suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like. As optional adhesive layers usually in contact with or situated between the hole blocking layer and the perylene photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyidiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 wight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical). The optional hole blocking layer may be applied to the substrate. A number of suitable and conventional blocking layers capable of forming an electronic barrier to holes between the adjacent photoconductive layer (or electrophotographic imaging layer) and the underlying conductive surface of substrate may be selected.

Charge transport components and molecules include a number of known materials, such as aryl amines, which layer is generally of a thickness of from about 5 microns to about 75 microns, and more specifically, of a thickness of from about 10 microns to about 40 microns, including molecules of the following formula

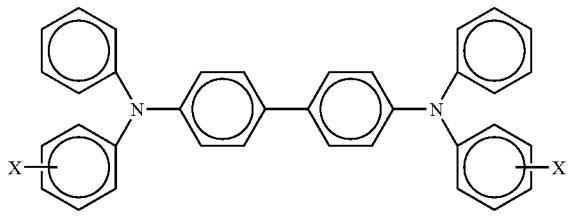

wherein X is alkyl, alkoxy, aryl, a halogen, or mixtures thereof, and especially those substituents selected from the group consisting of Cl and $CH_3$; and optionally wherein each X substituent can be selected for each of the four terminal rings resulting in at least four X substituents; and molecules of the following formula

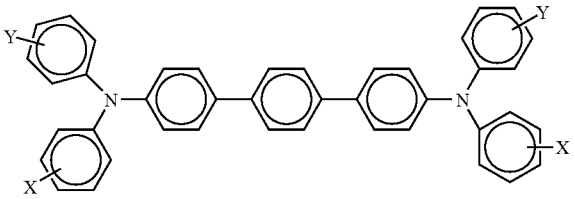

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight Mw of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the perylene photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the perylene photogenerating layer to be transported across the transport layer.

Examples of charge transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the perylene photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N, N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a mixture of a small molecule charge transport material and a polymeric charge transport material.

A number of processes may be used to mix, and thereafter apply the charge transport layer or layers coating mixture to the perylene photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like. The thickness of each of the charge transport layers in embodiments is from about 5 to about 75 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the perylene photogenerating layer can be from about 2:1 to 200:1, and in some instances 400:1. The charge transport layer substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and as illustrated herein, such as about 10 micrometers. In embodiments, this thickness for each layer is from about 1 micrometer to about 5 micrometers. Various suitable and conventional methods may be used to mix, and thereafter apply the overcoat layer coating mixture to the perylene photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The overcoat or top charge transport layer can comprise the same components as the charge transport layer wherein the weight ratio between the charge transporting small molecules, and the suitable electrically inactive resin binder is less, such as for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141,1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the percentages and carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36 or more. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

Illustrative examples of perylene pigments, especially when 1 to 3 charge transport layers are present, for incorporation into the photoconductors of the present disclosure are as illustrated herein, and include a number of known perylenes; and more specifically, benzimidazole perylene (BZP) of the formula

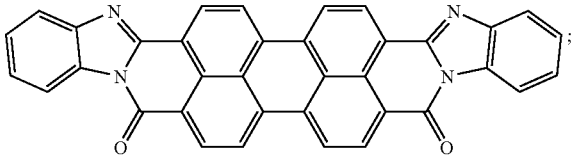

benzimidazole terperylene (BZT) of the formula

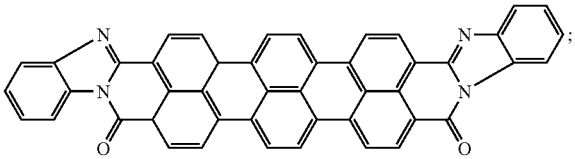

benzimidazole quaterperylene (BZQ) of the formula

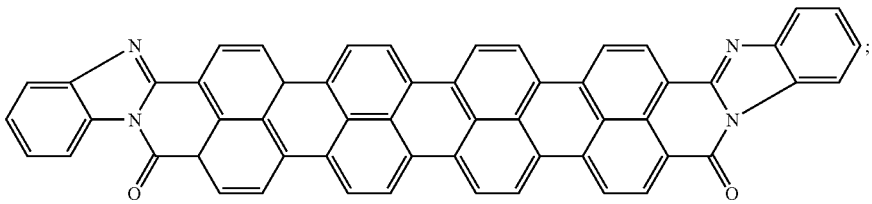

piperidine-modified benzimidazole terperylene (PBZT) of the formula

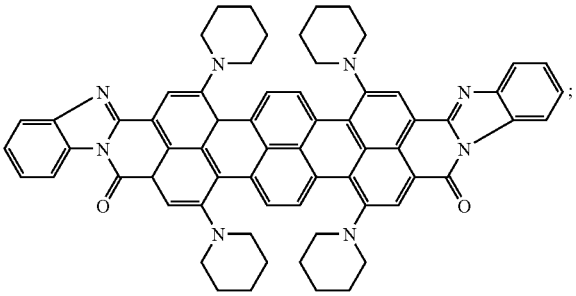

piperidine-modified benzimidazole perylene (PBZP) of the formula

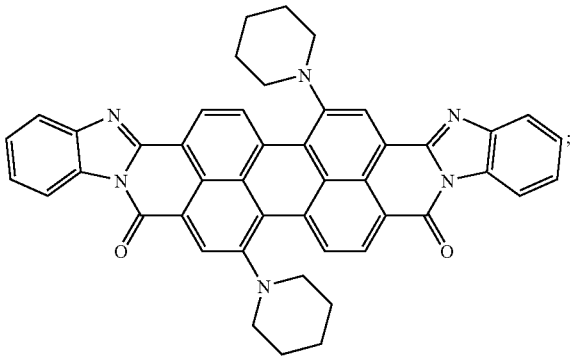

and piperidine-modified benzimidazole quaterperylene (PBZQ) of the formula

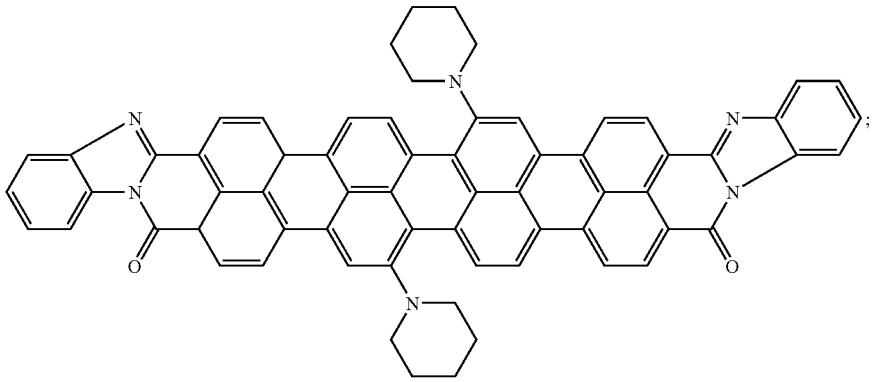

and the like, and mixtures thereof; isomers thereof, such as from 1 to about 99 weight percent of one perylene and from about 99 to about 1 weight percent of a second perylene; from about 60 to about 40 weight percent of one perylene and from about 40 to about 60 weight percent of a second perylene or isomers thereof; from about 50 weight percent of one perylene and 50 weight percent by weight of a second perylene and throughout where the first perylene is dissimilar than the second perylene. Similarly, mixtures of 3, 4, 5, and 6 formulas, and the like perylenes may be selected in embodiments.

With further reference to the perylenes, such as benzimidazole perylene (BZP), the cis isomer can be chemically designated as bisbenzimidazo(2,1-a-1',1'-b)anthra(2,1,9-def:6,5,10-d'e'f')diisoquinoline-6,11-dione, while the trans isomer has the chemical designation bisbenzimidazo(2,1-a-1',1'-b)anthra(2,1,9-def:6,5,10-d'e'f')diisoquinoline-10,21-dione. The perylene compositions illustrated herein are generally prepared by the condensation reaction of perylene-3,4,9,10-tetracarboxylic acid, or the corresponding anhydrides with an appropriate amine in quinoline, in the presence of a catalyst, and with heating at elevated temperatures, about 180° C. to about 230° C., the details of which are described in U.S. Pat. No. 4,587,189, the disclosure of which is totally incorporated herein by reference.

In one specific process embodiment, the perylene pigments can be prepared by the condensation reaction of perylene-3,4,9,10-tetracarboxylic acid or its corresponding anhydrides with an amine in a molar ratio of from about 1:2 to about 1:10, or in a ratio of from about 1:2 to about 1:3. This reaction is generally accomplished at a temperature of from about 180° C. to about 230° C., and preferably at a temperature of about 210° C. with stirring and in the presence of a catalyst. Subsequently, the desired product is isolated from the reaction mixture by known techniques such as filtration. Examples of reactants include perylene-3,4,9,10-tetracarboxylic acid, and perylene-3,4,9,10-tetracarboxylic acid dianhydride. Illustrative amine reactants include o-phenylene diamine 2,3-diaminonaphthalene; 2,3-diamino pyridine; 3,4-diamino pyridine; 5,6-diamino pyrimidene; 9,10-diamino phenanthrene; 1,8-diamino naphthalene; aniline; and substituted anilines.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

COMPARATIVE EXAMPLE 1

An imaging member or photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive layer contains 0.2 percent by weight based on the total weight of the solution of the copolyester adhesive (ARDEL™ D100, available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 grams of the known polycarbonate LUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of benzimidazole perylene (BZP) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the perylene dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting imaging member web was then overcoated with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A. G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

EXAMPLE I

An imaging member was prepared by repeating the process of Comparative Example 1 except that 0.096 grams of the silanol phenyl-POSS trisilanol (SO1458™, available from Hybrid Plastics, Fountain Valley, Calif.) were added into the BZP photogenerating layer dispersion, and the resulting dispersion was allowed to mix for at least 2 hours before coating.

EXAMPLE II

An imaging member is prepared by repeating the process of Comparative Example 1 except that the photogenerating layer dispersion is prepared by introducing 0.45 grams of the known polycarbonate LUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution are added 2.4 grams of benzimidazole terperylene (BZT), and 300 grams of ⅛ inch (3.2 millimeters) diameter stainless steel shot. This mixture is then placed on a ball mill for 8 hours. Subsequently, 2.25 grams of PCZ-200 are dissolved in 46.1 grams of tetrahydrofuran, and added to the BZT dispersion. This slurry is then placed on a shaker for 10 minutes. The resulting dispersion is, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer is deliberately left uncoated by any of the photogenerating layer material to facilitate adequate electrical contact by the ground strip layer that is applied later. The photogenerating layer is dried at 120° C. for 1 minute in a forced air oven to form a dry photogenerating layer having a thickness of 0.4 micrometer.

EXAMPLE III

An imaging member is prepared by repeating the process of Example II except that 0.24 grams of dicyclohexyltetrasilanol are added into the BZT photogenerating layer dispersion, and the resulting dispersion is allowed to mix for at least 2 hours before coating.

Electrical Property Testing

The above two photoreceptor devices (Comparative Example 1 and Example I) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity, and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 volts with the exposure light intensity incrementally increased by means of regulating a series of neutral density filters; the exposure light source was a 670 nanometer light emitting diode. The xerographic simulation was completed in an environmentally controlled light tight chamber at ambient conditions (40 percent relative humidity and 22° C.). The devices were also cycled to 3,000 cycles electrically with charge-discharge-erase. Four photoinduced discharge characteristic (PIDC) curves were generated, one for each of the above prepared photoconductors at both cycle=0 and cycle=3,000, and where V equals volt. The results are summarized as follows.

| | Cycle = 0 | | Cycle = 3,000 | |
|---|---|---|---|---|
| | Sensitivity ($Vcm^2/erg$) | $V_r$ (V) | Sensitivity ($Vcm^2/erg$) | $V_r$ (V) |
| Comparative Example 1 | 88 | 75 | 88 | 80 |
| Example I | 91 | 65 | 91 | 66 |

In embodiments, there is disclosed a number of improved characteristics for the photoconductive members as determined by the generation of known PIDC curves, such as minimization or prevention of $V_r$ cycle up by the physical doping of the silanol in the perylene photogenerating layer. More specifically, photosensitivity is measured as the initial slope of a photoinduced discharge characteristic (PDIC) curve, while $V_r$ is the residual potential after erase, and are used to characterize the PIDC. Incorporation of the silanol into the perylene photogenerating layer increased the photosensitivity by about 5 percent, reduced $V_r$ by about 10 volts, and prevented photoconductor cycle up with extended cycling.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer comprised of at least one charge transport component, and wherein said photogenerating layer is comprised of at least one photogenerating pigment comprised of a perylene and at least one silanol, and wherein said silanol is selected from the group comprised of the following formulas/structures

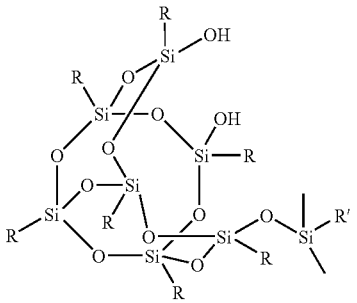

-continued

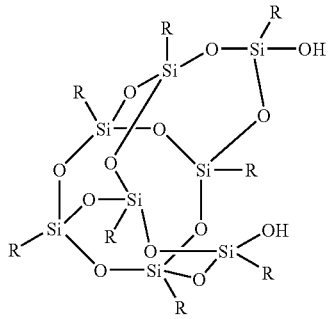

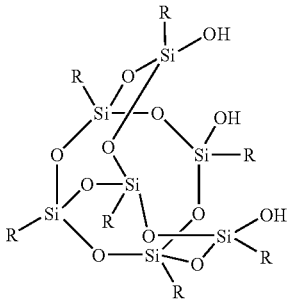

and

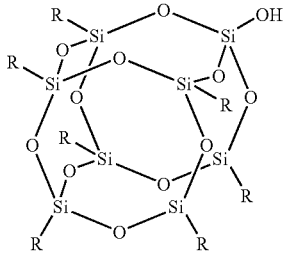

wherein R and R' are independently selected from the group consisting of alkyl, alkoxy, aryl, and substituted derivatives thereof, and mixtures thereof, and wherein said perylene is selected from the group consisting of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione; benzimidazole terperylene (BZT) of the formula/structure

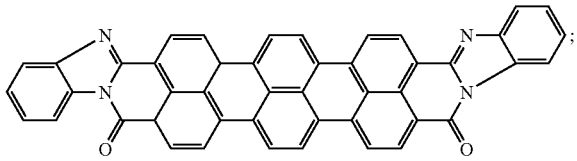

benzimidazole quaterperylene (BZQ) of the formula/structure

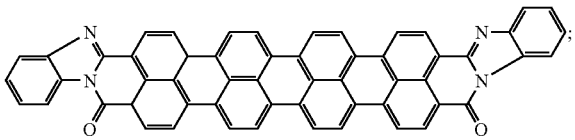

piperidine-modified benzimidazole terperylene (PBZT) of the formula/structure

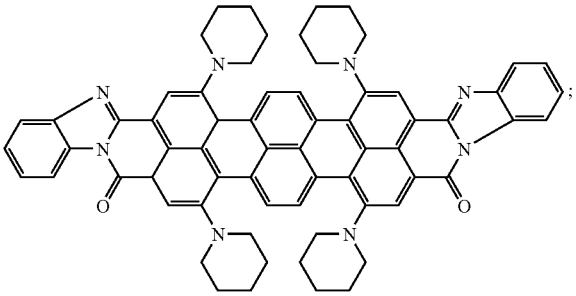

piperidine-modified benzimidazole perylene (PBZP) of the formula/structure

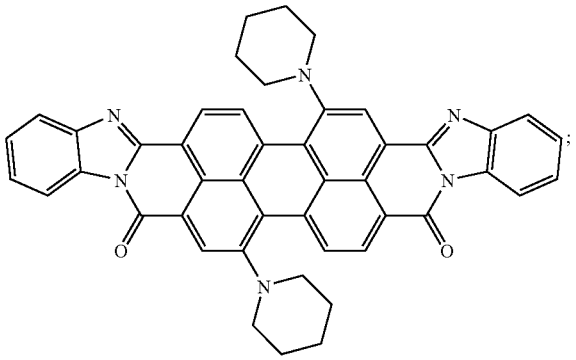

and piperidine-modified benzimidazole quaterperylene (PBZQ) of the formula/structure

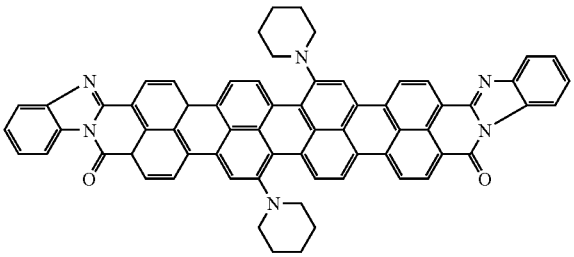

wherein said substrate is present, and wherein at least one charge transport layer is from 1 to about 4.

2. A photoconductor in accordance with claim 1 wherein said charge transport component is comprised of aryl amine molecules, and which aryl amines are of the formula/structure

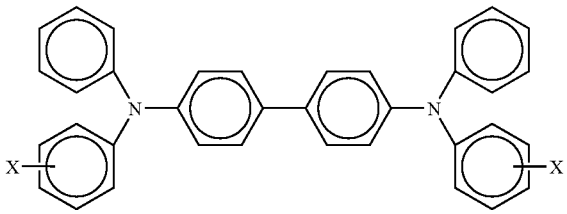

wherein X is selected from the group consisting of alkyl, alkoxy, aryl, and halogen, and mixtures thereof.

3. A photoconductor in accordance with claim 2 wherein said alkyl and said alkoxy each contains from about 1 to about 12 carbon atoms, and said aryl contains from about 6 to about 36 carbon atoms; and wherein the photoconductor contains a supporting substrate

4. A photoconductor in accordance with claim 2 wherein said aryl amine is N,N'-diphenyl-N,N-bis(3-methylphenyl)-1,1'-biphenyl-4,4'-diamine.

5. A photoconductor in accordance with claim 1 wherein said charge transport component is comprised of aryl amine molecules, and which aryl amines are of the formula

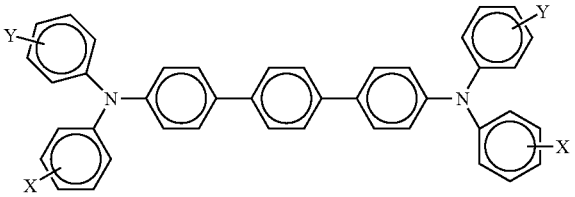

wherein X and Y are independently selected from the group consisting of alkyl, alkoxy, aryl, and halogen, and mixtures thereof.

6. A photoconductor in accordance with claim 5 wherein alkyl and alkoxy each contains from about 1 to about 12 carbon atoms, and aryl contains from about 6 to about 36 carbon atoms; and wherein said photoconductor contains a substrate in contact with said photogenerating layer.

7. A photoconductor in accordance with claim 5 wherein said aryl amine is selected from at least one of the group consisting of N, N'-bis(4-butylphenyl)-N,N'-di-p-tolyl-[p-terphenyl]-4,4"-diamine, N,N'-bis (4-butylphenyl)-N,N'-di-m-tolyl-[p-terphenyl]-4,4"-diamine N,N'-bis (4-butylphenyl)-N,N'-di-o-tolyl-[p-terphenyl]-4,4"-diamine, N,N'-bis(4-butylphenyl) -N,N'-bis-(4-isopropylphenyl)-[p-terphenyl]-4,4"-diamine, N,N'-bis(4-butylphenyl) -N,N'-bis-(2-ethyl-6-methylphenyl)-[p-terphenyly]-4,4"diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4" -diamine; and wherein said photoconductor contains a supporting substrate.

8. A photoconductor in accordance with claim 1 wherein said silanol is present in an amount of from about 0.1 to about 40 weight percent; wherein said charge transport contains hole transport molecules and a resin binder; and wherein said photogenerating layer contains said at least one perylene photogenerating pigment and a resin binder.

9. A photoconductor in accordance with claim 1 further including in at least one of said charge transport layers an antioxidant optionally comprised of at least one hindered phenolic polymer, and a hindered amine.

10. A photoconductor in accordance with claim 1 wherein said photogenerating layer further contains a photogenerating pigment comprised of at least one of a metal phthalocyanine, and a metal free phthalocyanine.

11. A photoconductor in accordance with claim 1 further including a hole blocking layer, and an adhesive layer, and wherein said substrate is present.

12. A photoconductor in accordance with claim 1 wherein said photoconductor is a flexible belt or a drum, and said silanol possesses a weight average molecular weight $M_w$ of from about 700 to about 2,000.

13. A photoconductor in accordance with claim 1 wherein said at least one charge transport layer is from 1 to about 3 layers.

14. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer, and wherein said photoconductor includes a supporting substrate.

15. A photoconductor in accordance with claim 14 wherein said top layer is comprised of a hole transport component, a resin binder, and an antioxidant, and said bottom layer is comprised of at least one charge transport component, a resin binder, and an optional antioxidant.

16. A photoconductor in accordance with claim 1 wherein said silanol is present in an amount of from about 0.1 to about 40 weight percent.

17. A photoconductor in accordance with claim 1 wherein said silanol is present in an amount of from about 1 to about 30 weight percent.

18. A photoconductor in accordance with claim 1 wherein said perylene mixture is comprised of from about 40 to about 60 percent of bisbenzimidazo(2,1-a-1',2'-b) anthra(2,1,9-def: 6,5,10-d'e'f')diisoquinoline-6,11-dione, and from about 60 to about 40 percent of bisbenzimidazo(2,1-a:2',1'-a)anthra(2,1,9-def: 6,5,10-d'e'f')diisoquinoline-10,21-dione.

19. A photoconductor in accordance with claim 1 wherein said perylene mixture is comprised of from about 1 to about 99 percent of bisbenzimidazo(2,1-a-1',2'-b) anthra(2,1,9-def: 6,5,10-d'e'f')diisoquinoline-6,11-dione, and from about 99 to about 1 percent of bisbenzimidazo(2,1-a:2',1'-a)anthra(2,1,9-def: 6,5,10-d'e'f')diisoquinoline-10,21-dione.

20. A photoconductor comprised in sequence of a substrate, a photogenerating layer, and at least one charge transport layer comprised of at least one charge transport component, and wherein said photogenerating layer is comprised of a silanol and a perylene photogenerating pigment, and wherein said silanol is selected from the group comprised of the following formulas/structures

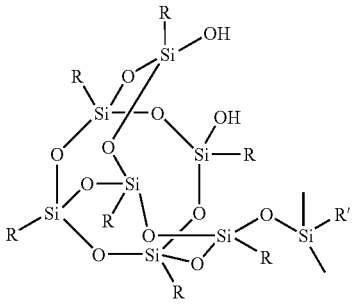

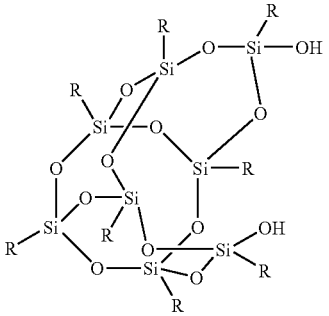

-continued

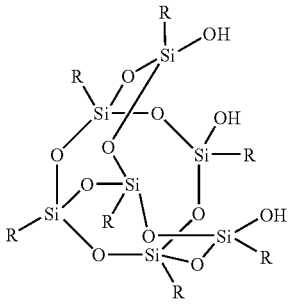

and

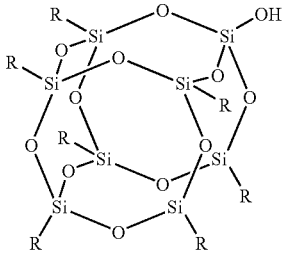

wherein R and R' are independently selected from the group consisting of alkyl, aryl, alkoxy, and mixtures thereof; and optionally wherein said silanol is present in an amount of from about 0.05 to about 40 weight percent, and wherein said perylene is comprised of a mixture of bisbenzimidazo(2,1-a-1',2'-b) anthra(2,1,9-def:6,5,10-d'e'f')diisoquinoline-6,11-dione and bisbenzimidazo (2,1-a:2',1'-a)anthra(2,1,9-def:6,5,10-d'e'f')diisoquinoline-10,21-dione.

21. A photoconductor in accordance with claim 20 wherein said silanol is present in an amount of from about 0.1 to about 10 weight percent; said alkyl and alkoxy each contains from 1 to about 12 carbon atoms; said aryl contains from 6 to about 36 carbon atoms, and wherein at least one charge transport layer is from 1 to 2 layers.

22. A photoconductor in accordance with claim 20 wherein at least one of said charge transport layers contains a resin binder: said photogenerating layer is situated between said at least one charge transport layer and said substrate, and which layer contains a resin binder said silanol is present in an amount of from about 0.05 to about 12 weight percent; and wherein said at least one is from 1 to about 4.

23. A photoconductor in accordance with claim 20 wherein said silanol is present in an amount of from about 0.1 to about 15 weight percent, and wherein said at least one charge transport layer is from 1 to about 5.

* * * * *